US007068134B2

(12) United States Patent
Olsen

(10) Patent No.: US 7,068,134 B2
(45) Date of Patent: Jun. 27, 2006

(54) ELECTROMAGNETIC WORK COIL

(76) Inventor: Robert R. Olsen, 21825 1st Ave. W., Bothell, WA (US) 98021

( * ) Notice: Subject to any disclaimer, the term of this patent is extended or adjusted under 35 U.S.C. 154(b) by 0 days.

(21) Appl. No.: 10/627,257

(22) Filed: Jul. 24, 2003

(65) Prior Publication Data

US 2004/0070478 A1 Apr. 15, 2004

Related U.S. Application Data

(60) Provisional application No. 60/398,982, filed on Jul. 25, 2002.

(51) Int. Cl.
*H01F 7/20* (2006.01)

(52) U.S. Cl. ..... 335/291

(58) Field of Classification Search ..... 335/285–294; 361/144–145; 336/210, 225, 226, 230; 72/56
See application file for complete search history.

(56) References Cited

U.S. PATENT DOCUMENTS

| | | | | | |
|---|---|---|---|---|---|
| 3,126,046 | A * | 3/1964 | Richey | 72/56 |
| 3,196,649 | A | 7/1965 | Furth | 72/56 |
| 3,825,819 | A | 7/1974 | Hansen et al. | 324/34 R |
| 3,998,081 | A | 12/1976 | Hansen et al. | 72/56 |
| 4,061,007 | A * | 12/1977 | Hansen et al. | 72/56 |
| 4,116,031 | A * | 9/1978 | Hansen et al. | 72/56 |
| 4,127,933 | A * | 12/1978 | Hansen et al. | 29/605 |
| 4,135,379 | A * | 1/1979 | Hansen et al. | 72/56 |
| 4,148,091 | A | 4/1979 | Hansen et al. | 361/156 |
| 4,986,102 | A * | 1/1991 | Hendrickson et al. | 72/56 |
| 5,046,345 | A | 9/1991 | Zieve | 72/56 |
| 5,575,165 | A | 11/1996 | Roseberry | 72/56 |
| 5,860,306 | A | 1/1999 | Daehn et al. | 72/56 |
| 6,489,871 | B1 * | 12/2002 | Barton | 335/285 |

* cited by examiner

*Primary Examiner*—Lincoln Donovan
*Assistant Examiner*—Bernard Rojas
(74) *Attorney, Agent, or Firm*—Dean A. Craine

(57) ABSTRACT

An improved electromagnetic work coil for use with an electromagnetic force machine that produces a pulling (tension) force on a conductive panel work piece. The electromagnetic work coil comprises a coil with insulated conductor windings passing through a clamped stressing region. The work coil further contains mating terminals and is encapsulated in a nonmagnetic housing. A clamp on the stressing region comprises two clamp surfaces and a part in tension outside of the stressing region to tangentially compress the windings in the stressing region. The preferred embodiment the winding paths around the stressing region are made symmetric to provide a centered linear pulling area with a symmetric magnetic field. The conductor windings are tapered that increase in height and width outside of the stressing region to improve thermal and electrical conductivity and decrease the magnetic field outside of the stressing region.

9 Claims, 5 Drawing Sheets

ELECTROMAGNETIC WORK COIL

This is a utility patent application which claims benefit of U.S. Provisional Application No. 60/398,982 filed on Jul. 25, 2002.

BACKGROUND OF THE INVENTION

1. Field of the Invention

This invention is directed to electromagnetic work coils for electromagnetic force machines that produce a pulling (tension) force on a conductive material, which may be used for metal forming, removing dents, or performing nondestructive proof load tests.

2. Description of the Related Art

In the past, a variety of electromagnetic force (EMF) pulling machines and electromagnetic coils have been developed for use in the production and maintenance of conductive panel work pieces to perform nondestructive tests on panel bonds and to remove dents.

U.S. Pat. No. 4,148,091, issued to Karl A. Hansen et al. on Apr. 3, 1979 entitled "Electromagnetic force machine with universal portable power supply," and U.S. Pat. No. 3,825,819, issued to Karl A. Hansen et al on Jul. 23, 1974 entitled "Dynamic Proof Loading of Metal Bond Structures Using Pulsed Magnetic Fields," describe such a machine. U.S. Pat. No. 5,046,345, issued to Peter B. Zieve on Sep. 10, 1991 entitled "Power Supply for Electromagnetic Proof Load Tester and Dent Remover," describes a power supply for such a machine. U.S. Pat. No. 4,986,102, issued to I. Glen Hendrickson et al. on Jan. 22, 1991 entitled "Electromagnetic dent remover with tapped work coil," describes another power supply and electromagnetic coil for such a machine.

U.S. Pat. No. 4,061,007, issued to Karl A. Hansen et al. on Dec. 6, 1977 entitled "Electromagnetic dent remover with electromagnetic localized work coil," and U.S. Pat. No. 4,127,933, issued to Karl A. Hansen et al. on Dec. 5, 1978 entitled "Method of making work coil for an electromagnetic dent remover," describe several electromagnetic coils for use with such a machine and the methods used to manufacture them. U.S. Pat. No. 4,116,031, issued to Karl A. Hansen et al. on Sep. 26, 1978 entitled "Flux concentrator for electromagnetic pulling," describes another electromagnetic coil for such a machine that utilizes a secondary coil and is referred to as a flux concentrator.

U.S. Pat. No. 5,575,165, issued to Thomas J. Roseberry on Nov. 19, 1996 entitled "Method of dent removal using a resonance damping vacuum blanket," describes a vacuum system for stiffening the panel work piece for use with such a machine and electromagnetic coil.

The electromagnetic work coils for electromagnetic force (EMF) pulling machines create a pulling (tension) force on conductive material by first presenting a slowly increasing tangential magnetic field that penetrates into a conductive panel work piece. It is a requirement that the magnetic field be presented slowly enough so the skin depth of eddy currents reacting in the work piece is greater than the material thickness. This minimizes the reacting Lorentz force so that the work coil and conductive panel work piece do not push away from each other. Next, the work coil quickly must collapse the magnetic field from the face of the work piece. The collapse must be sufficiently rapid enough such that the skin depth of reacting eddy currents is less than the panel work piece thickness. The reacting eddy currents in the presence of the magnetic field cause a Lorentz force that is oriented normal to both and draws the work piece and the work coil together. This pulling force, or tension force, may be used for nondestructive pulling tests or to pull a dent out of the work piece.

The physical requirements of the work coil for an EMF pulling machine are different than a coil or device used with an EMF machine that pushes. In a typical EMF machine that pushes, a repulsive force is used to compact, swage, or rapidly move a conductive part away from the work coil. Since the force on the work coil is in the opposite direction, the design for a pushing work coil is significantly different. The coil windings can be backed and supported directly to withstand the pushing forces. For the pulling work coil the windings must withstand a pulling force. The windings must slowly present the magnetic field with a significant current density. This results in a greater amount of energy dissipated in the work coil in the form of heat that must be dissipated to maintain conductance and material strength.

While prior art work coils have proven to be satisfactory for some work, improvements are desired. It is desired to pull dents from thicker, harder, or less conductive materials like titanium. It is further desired to pull higher aspect ratio dents with greater plastic deformation. This requires a coil that can withstand greater thermal and mechanical stress. As the panel work piece material increases in thickness, the presentation of the magnetic field has to be slower to prevent pushing the panel work piece and work coil away from each other. This requires increased energy from the EMF power supply that will be converted to heat in the electrical resistance of the coil windings. The work coil must be cooled or capable of dissipating the extra heat. Additionally, for a thicker panel work piece, it is desirable to increase the magnetic field strength to create higher pressure necessary to perform work on the material. The increased magnetic field requires an increased current density and will impart additional mechanical and thermal stress on the coil windings. We desire to do work to the work piece without doing work on the coil so that the coil can be reused and jobs accomplished safely. At the energy levels of interest, some prior art coils have failed destructively ejecting molten copper.

As the panel work piece thickness is increased, a repulsive force increases due to the imperfect slow field presentation that will reduce the effectiveness of the process. This force may be minimized by slowing down the field presentation or it can be counteracted by preloading or pushing the work coil into the work piece. If the preloaded force is overcome, the gun and panel work piece separation velocity can be minimized with a heavier gun and more rigidly backed panel work piece.

Another method developed by the Inventor to improve performance with thicker panels is to apply a vacuum between the work coil and the panel work piece. This is attractive because it provides atmospheric pressure applied evenly and directly behind the panel material and behind the work coil. This technique should not be confused with the concept taught in U.S. Pat. No. 5,575,165 where a vacuum blanket is used to stiffen a thin aluminum panel around the area to be pulled to dampen any resonance. The performance of preloading is an improvement in some cases whether it is applied by the operator pushing or by an applied vacuum.

SUMMARY OF THE INVENTION

Accordingly, it is an object of this invention to provide an improved electromagnetic work coil to use with electromagnetic force machines that produces a pulling (tension) force on a conductive work piece.

It is a further object of this invention to provide an electromagnetic work coil with a longer lifetime.

It is a further object of this invention to provide an electromagnetic work coil that can create a larger and stronger magnetic field that is tangential to the work piece.

It is a further object of this invention to provide an electromagnetic work coil that can provide a slower presentation of the magnetic field to provide penetration into thicker work pieces.

It is a further object of this invention to provide an electromagnetic work coil that is more efficient with the use of energy to minimize the size and weight of the power supply necessary to power the electromagnetic work coil.

It is a further object of this invention to provide an electromagnetic work coil that improves the performance when operator or vacuum preload is applied.

These and other objects are met by the invention disclosed herein that improves the performance and efficiency of the work coil used with an electromagnetic pulling machine. As taught in U.S. Pat. No. 4,148,091, the present invention has a stressing region where the electric current through conductive windings of the work coil creates a tangential magnetic field that is concentrated on a work surface. The stressing region is composed of multiple windings of conductors that are insulated from each other. The present invention improves the mechanical strength of this stressing region by providing a clamp around the windings of the stressing region to place the windings in compression in the axis of the tangential magnetic field. This compression has a couple of advantages. It isolates the windings in the area leading to the stressing region from tangential forces that are imparted on the windings in the stressing region. It also compresses the insulation between the windings to evenly counteract the tangential forces and prevent movement of windings. With the cylindrical coils described in U.S. Pat. No. 4,148,091, the tangential forces were partly counteracted by the winding area leading to the stressing region and resulted in stretched, buckled, and displaced windings. The compression applied by the clamp helps isolate and prevent this. The clamp also allows thinner insulation to be used between windings.

Minimizing the area taken up by insulation in the stressing region allows a higher winding density, which is desired to decrease the electric current necessary to create the large magnetic field. While such clamping may benefit any electromagnetic coil, the clamp of the present invention especially benefits the application for electromagnetic dent removal where the panel work piece is pulled into and formed by the work coil. To accomplish this, a counteracting pushing force from the clamp material surrounding the stressing region needs to be translated through the insulation layers to the windings that are performing the pulling. The clamp improves the integrity of the stressing region to translate this force. Additionally the clamp can be tapered to trap the windings and further help translate the force for pulling dents.

The embodiments of the present invention also provide winding path and corresponding magnetic field geometry improvements. The cylindrical coils taught by U.S. Pat. No. 4,148,091 have a crescent shaped pulling area in an arc with the windings around the center of the coil. A disadvantage of this geometry is that the magnetic field extending normal to the panel work piece is concentrated higher in the center of the coil. As a result the field is drawn inside the copper windings of the stressing region. This causes excessive tangential forces on those windings that are not evenly balanced by corresponding forces in adjacent windings. The embodiments of the present invention take advantage of other return paths for windings symmetrically around the linear stressing region. The complete set of possible return paths of the windings can be visualized by cutting a toroid in half where the cut face is adjacent the panel work piece. Rather than a cylindrical coil, it is beneficial to have the return path of windings symmetric and spread out around the stressing region. This is beneficial for multiple reasons. By providing symmetric arc paths around the stressing region, the normal and internal magnetic fields that do not contribute to the desired work are minimized. This decreases the magnitude of the tangential forces on the windings that have limited the prior art designs. The tangential forces that remain are then balanced by opposing windings within a linear stressing region due to the symmetry of the magnetic field. This optimized symmetric magnetic field further isolates the stressing region tangentially from the surrounding area.

Spreading out the return path windings around the stressing region results in a lower inductance coil that is more efficient. As the inductance of the coil is decreased without sacrificing the pulling performance, the power supply for energizing the present invention can take advantage of this efficiency and be designed lighter and smaller. Efficiency of the present invention is also provided as every winding in the stressing region gets to contribute to the magnetic field. With the prior art cylindrical coil a number of windings near the center of the coil in the stressing region had to be diminished with lower current concentration to strengthen the winding and reduce the force from the large central magnetic field.

Spreading out the return path windings has several other important advantages. If the coil is made from a precut ribbon of copper as described in U.S. Pat. No. 4,127,933, a difficulty of making the coil is that the diameter, insulation, and copper thickness has to be perfect to line up the precut features added to the copper windings. With the present invention, the windings can also be manufactured from precut copper but the alignment is only important through the stressing region. Any slack or tolerance variation can be taken up outside of it. Another advantage of spreading out the windings is that the electric isolation from winding to winding only becomes critical near and inside the stressing region. Outside the stressing region distances can be increased with extra and more economic insulation material. Finally, the advantage of the spread out windings is that conductive windings themselves act as thermal conduits of heat, transferring the heat away from the stressing region. Spreading out the windings provides greater heat capacity and greater available surface area to dissipate the heat. With increased winding thickness or winding spacing, cooling holes can be tolerated outside of the stressing region for forced air or other cooling means.

With a symmetric return path of windings around the coil, the stressing region is now located at the center of the coil. This too has several advantages. In the prior art, the stressing region was offset to one side of the coil. With the stressing region located at the center of the work coil, the forces that are not cancelled at the stressing region are normal to the panel work piece and presented without a large moment to the mass of the coil and to the gun in which the coil is mounted. This makes it easier for the operator to apply a preload. When the surface area around the stressing region is equal, a vacuum is applied between the coil and the panel work piece to provide a preload, it does not present a mechanical moment on the coil. For the cylindrical work coil with a stressing region offsets to one side, the resulting moment has to be counteracted. Another benefit of a centrally located stressing region is that the high electromagnetic field that is generated is inherently better shielded. The copper windings surrounding the stressing region help confine the magnetic field externally without extra shielding. A conductive shell around the coil can further help confine the EM pulse.

Further improvements to work coil geometry are disclosed in embodiments for application to shaped panel work pieces. Many conductive panel work pieces, on which an electromagnetic dent remover is used, are functionally in a convex shape, such as the leading edge of an airplane wing or the surface of an aerodynamic fuselage. The winding current path leading to the stressing region can take advantage of this geometry by more closely following the convex contour of the panel work piece. This can enhance the tangential magnetic field in the pulling surface area. In other applications, the panel work piece is in a concave shape such as the inside of a jet engine inlet. In this case it is beneficial to conform to the concave shape so that the central stressing region is in mechanical proximity to the panel work piece. To match the concave shape, rather than making the winding current path follow the concave contour and thus degrade the presented magnetic field, the coil is rotated ninety degrees and the necessary profile cut in the orthogonal axis.

A couple of manufacturing methods can be utilized and the inherent attributes of those methods will allow coils of varying capabilities and features to be produced. The simplest embodiment is made from a long strip of copper that is precut in 2D by water-jet or punched with the desired features and then wound and insulated. One benefit of this approach is the ability to stack windings both horizontally and vertically. Another method is to cut the same copper strip in 3D with a CNC to additionally allow variable thickness of the windings. Varying the thickness of the windings can be beneficial as the area outside of the stressing region can be made thicker to provide extra strength, lower current density, less resistance, and greater thermal conductivity. The area leading to the stressing region can be tapered and narrowed to provide the higher current density in the stressing region. Another embodiment accomplishes the same using the 2D cut strip of copper by winding it around precut pieces of a conductive material like aluminum or copper. Another embodiment can utilize advantages afforded by wire EDM. Rather than bending copper into windings, a solid conductive material like copper can be milled and then cut by wire EDM so the geometry of each winding is varied continuously. With the wire EDM the winding thickness can be increased dramatically outside of the stressing region in a tapered and controlled fashion. This has advantages for providing strength and heat capacity outside of the stressing region but is also presently a more expensive method of manufacture.

The materials used for making a work coil of the present invention are also varied. The conductor material is desired to be as conductive as possible to minimize resistance. This is especially important for electromagnetic metal forming that pulls instead of pushes because the necessary slow presentation of the magnetic field can locally dissipate a lot of heat. Cooling a number of materials like copper can further minimize resistance. However the strength of the windings in the stressing region is important since it is a primary mechanical working element to produce forming stresses in the panel work piece. A material like aluminum dispersion strengthened copper is attractive as it extends the annealing temperature and strengthens the copper while minimally degrading the electrical and thermal conductivity.

An embodiment of the present invention further strengthens the windings in the stressing region by using a bonded metal for strength. A higher conductivity material such as copper can be explosively bonded to a lower conductivity material such as titanium or stainless steel. Both materials compose a winding. This technique allows higher current densities in a smaller copper region while maintaining the geometric and even extra material strength of the windings. The magnetic field is drawn into the copper some by a percentage of cross sectional current flowing in the secondary material, which can be beneficial as the force on the copper is away from the panel work piece.

In prior art, the copper was spirally wound with Kevlar and vacuum impregnated with an epoxy. In the present invention the Kevlar or fiberglass can be draped over the windings to provide structural integrity and support for the windings in the stressing region. To maintain dielectric integrity it is best if the material for insulating the windings in the stressing region is solid with a controlled thickness. A material like polyimide film is attractive because of its excellent dielectric strength and capability to withstand heat. Other materials and methods of insulation exist. It is important to realize the critical dielectric insulation strength is the insulation between the coil and the conductive panel work piece. The insulation requirement between windings is generally less. The clamp material near the stressing region could be a strong insulating material like G-10. A fairly lower conductivity and low permeability material such as titanium or stainless steel can be used in proximity of the stressing region, such as bolts for the clamp. A high permeability ferromagnetic material will magnetically saturate and fight the rapidly collapsing field that is desired.

If the temperature of the coil is decreased the resistance of the windings of the coil is decreased. While we may wish to even try a super-conducting coil, typically the thermal mass and heat conductivity of the panel work piece is significant and the coil windings are too close of a proximity to the panel work piece. Usually the described machines are used on skin panels that are mounted on an airplane or other part when there is no access to the back of the panel work piece. However, cooling of the work coil prior and during use can be beneficial. With the symmetric clamp of the present invention, cooling holes in the clamp can be aimed over the pulling area to form a dry air curtain and help prevent ice buildup during use.

DESCRIPTION OF THE PREFERRED EMBODIMENT(S)

Figure 1:
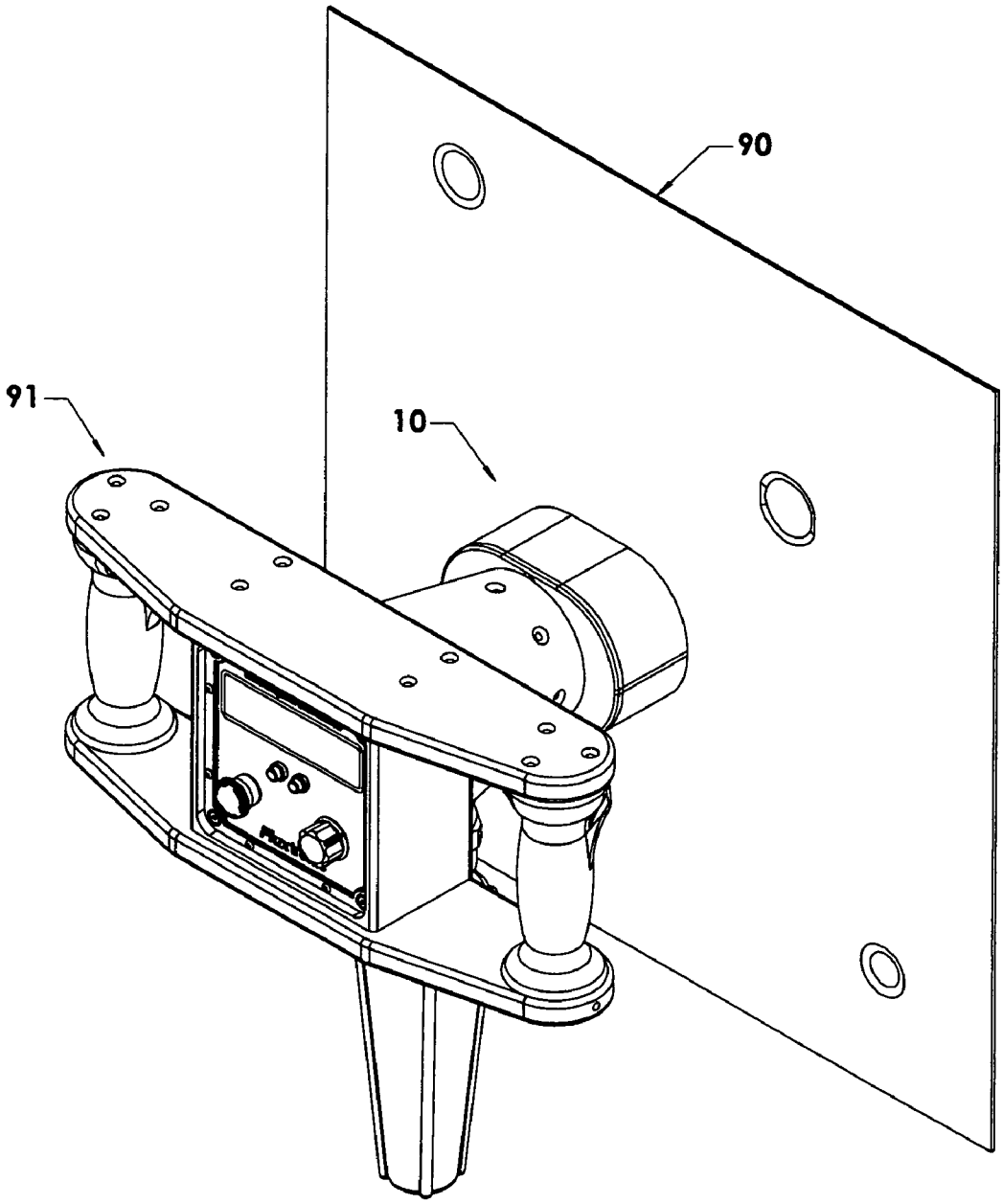
FIG. 1 is a perspective view of a work coil mounted in an electromagnetic dent remover gun, adjacent a dented panel work piece.

FIG. 1 shows a perspective view of a preferred embodiment electromagnetic work coil, generally referenced as 10, mounted in an example electromagnetic pulling gun 91 and positioned adjacent a conductive panel work piece 90. An electromagnetic pulling gun 91 with work coil 10 is powered by an electromagnetic pulling power supply (not shown) capable of providing a slowly rising current followed by a rapid opposing current. When energized by an electromagnetic pulling power supply, the work coil 10 imparts a pulling or tension force in the panel work piece 90. A pulling or tension force may be used to pull dents out of the work piece 90. When used to pull dents, the electromagnetic pulling gun 91 has been commonly referred to as an electromagnetic dent puller or an electromagnetic dent remover.

FIGS. 2A–2D shows a prior art cylindrical electromagnetic work coil, generally referenced as 70. The cylindrical electromagnetic coil 70 is composed of conductive coil windings 71, spirally wrapped with Kevlar or fiberglass fabric, and wound around a center dielectric core 72. The coil windings 71 are potted or encapsulated within insulating shell 73. The coil terminals 84 provide conductive mating surfaces to interface with the pulling gun 91. The geometry of the coil windings 71 defines the shape of the magnetic field and provides mechanical strength, so they largely define the performance of cylindrical electromagnetic coil 70.

The coil windings 71 contain pre-punched tapered apertures 85 and machined slots 87 and 88 to guide the current in a specific path. The slots 87 and 88 are machined after the coil 70 is wound and potted. As shown in FIG. 2C, the coil windings 71 comprise the central stressing region 80, two lead-in winding regions 81, 81', and the return path winding region 82. The stressing region 80 is the region of the coil 70 that can pull dents and has the highest magnetic field due to apertures 85 and slot 87 which route the energizing current into the highest density. The lead-in winding regions 81, 81' has a tapered magnetic field that decreases as the aperture 85 tapers and provides additional conductive cross sectional area. In the return path winding region 82, the current is routed away from the panel work piece 90 by slot 88.

Figure 2A:
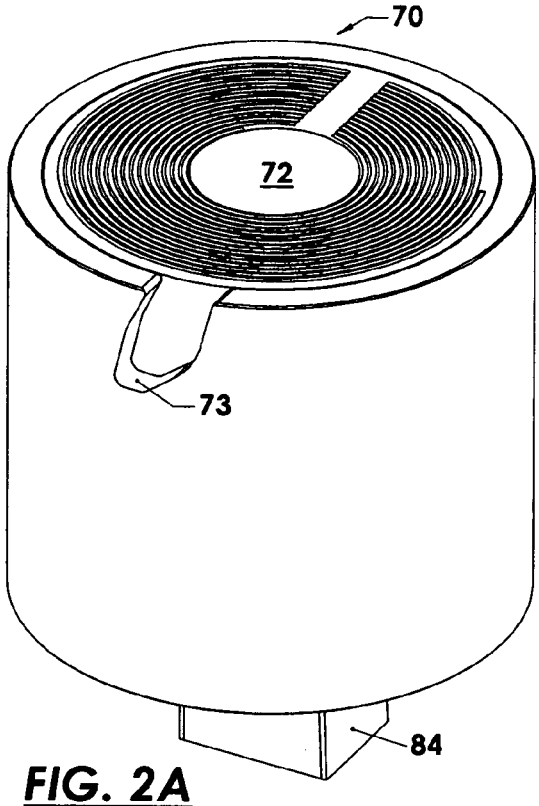
FIG. 2A is a perspective view of a cylindrical electromagnetic coil found in the prior art.
Figure 2B:
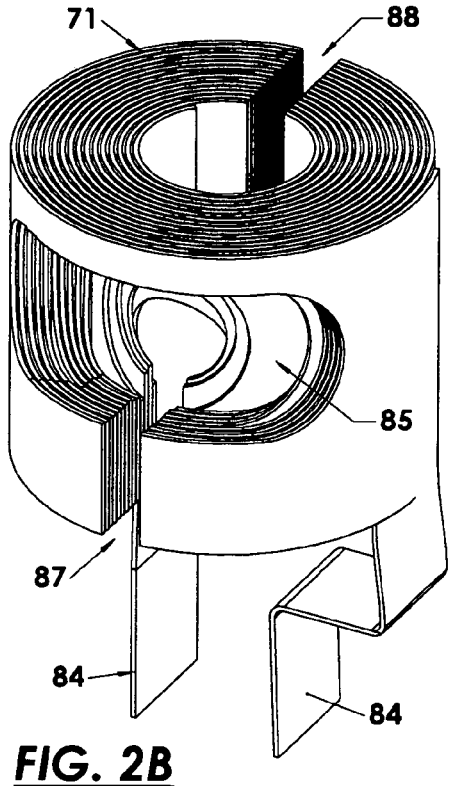
FIG. 2B is a perspective view of the coil shown in FIG. 1 showing the conductor windings in the coil.
Figure 2C:
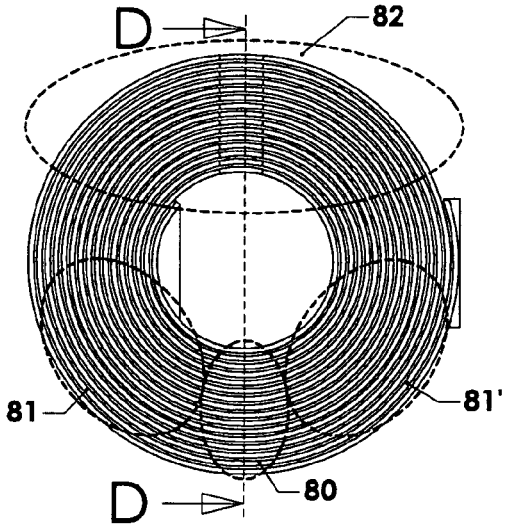
FIG. 2C is a top plan view of the work surface of the coil shown in FIG. 2A.
Figure 2D:
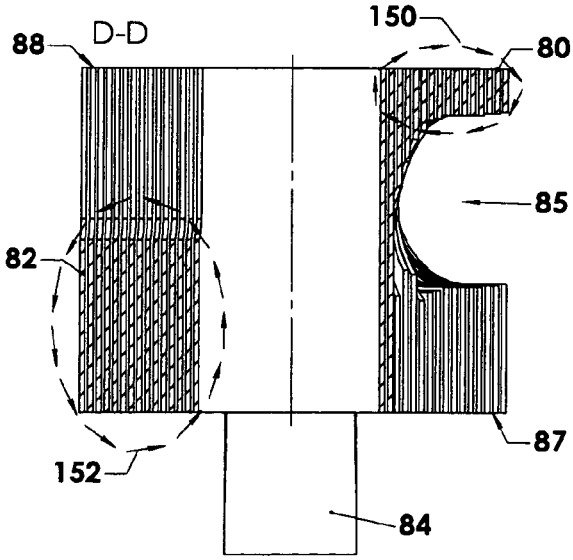
FIG. 2D is a sectional side elevation view of the coil shown along line D—D in FIG. 2C.

FIG. 2D shows more clearly the locations of the stressing region 80 and the return path winding region 82. With an energized current into the page through stressing region 80, the magnetic field 150 is represented with the clockwise vectors around stressing region 80. With an energized current out of the page through the return path winding region 82, the magnetic field 152 is represented with the counterclockwise arrows around the return path winding region 82. Since the same current must flow through both regions 80, 82 the magnetic field 150 is stronger around the denser windings in stressing region 80.

Despite the complex winding geometry of prior art cylindrical coil 70, there is always a strong magnetic field vector through the middle of a cylindrical coil 70 due to a consistent winding path around the center dielectric core 72. To help compensate this central vector the inside windings of stressing region 80 are increased in height with successively smaller apertures 85 and a limited depth on machined slot 87. This helps taper the current density of the inside coil windings 71 and reduces tangential Lorentz forces.

The strong monopole of the cylindrical coil 70 forces the magnetic field 150 into the inside windings of stressing region 80 and the inside windings of return path winding region 82 as shown. This creates increased Lorentz force and voltage stress on the inside coil windings 71. The Lorentz force is normal to the energizing current and normal to the resultant magnetic field, so it is tangential with the working surface of the coil 70. The tangential force and voltage stress between coil windings 71 on the inside edge in the stressing region 80 is a cause of failure in these prior art cylindrical coils 70. Often the winding material becomes stretched over successive operations because the coil windings 71 in the stressing region 80 do not have the strength to withstand tangential forces. The dielectric potting or encapsulation does not provide sufficient restraint and dielectric through heat and use.

Figure 3A:
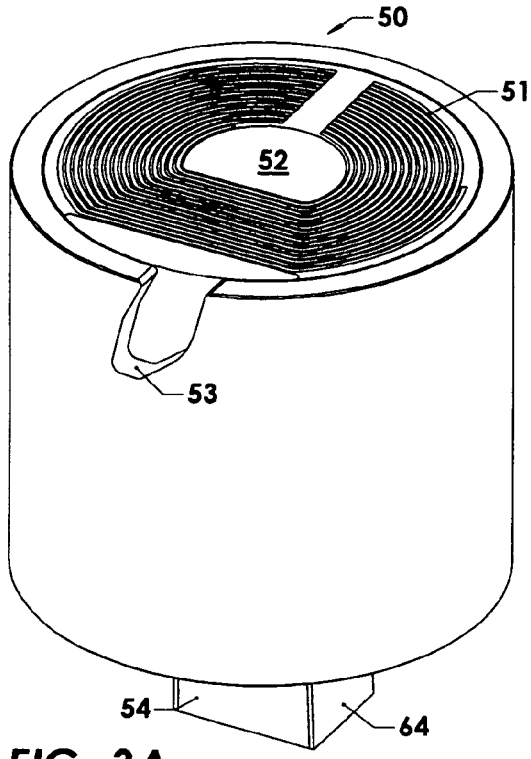
FIG. 3A is a perspective view of the improved work coil disclosed herein with a clamped linear stressing region.
Figure 3B:
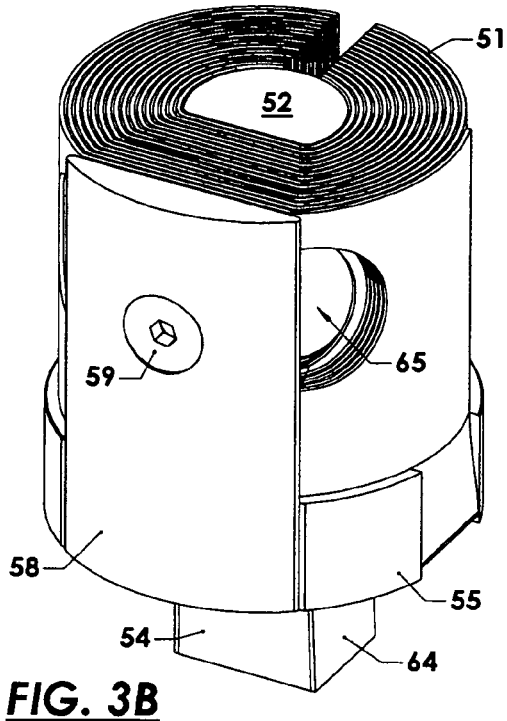
FIG. 3B is a perspective view of the conductor windings and clamp of the coil shown in FIG. 3A.
Figure 3C:
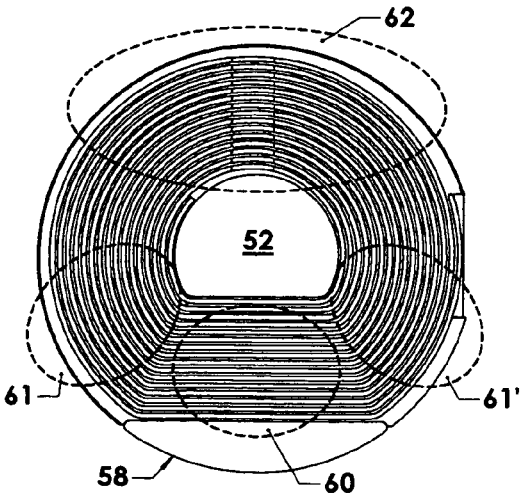
FIG. 3C is a top plan view of the work surface of the coil shown in FIG. 3A.
Figure 3D:
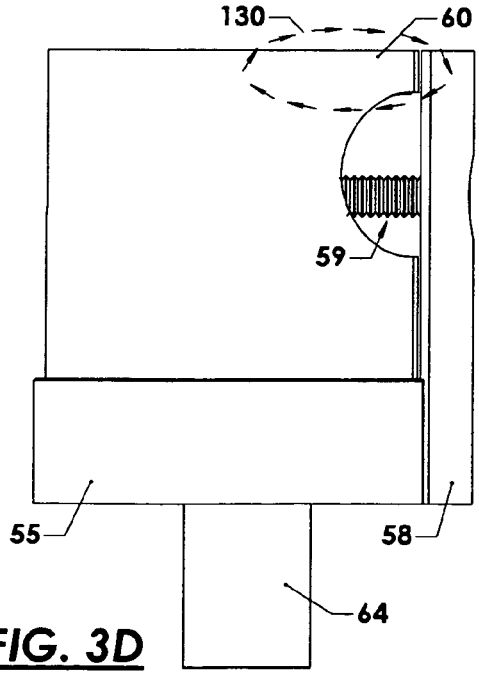
FIG. 3D is a side elevation view of the conductor windings and clamp of the coil shown in FIG. 3A.

The embodiment of the present invention shown in FIG. 3A is an improved cylindrical electromagnetic work coil, generally referenced as 50. The improved cylindrical coil 50 comprises similar components to cylindrical coil 70 with conductive coil windings 51 spirally wrapped with Kevlar or fiberglass fabric and wound around a center dielectric core 52. Similarly the coil windings 51 are potted or encapsulated within the shell 53. Similarly the coil terminals 64 provide conductive mating surfaces to interface with the pulling gun 91 shown in FIG. 1.

However, the coil windings 51 in stressing region 60 have been relieved from the lead-in regions 61, 61' by making them linear. This alters both the magnetic field 150 and the strength of the coil windings 51. The reason for doing this is the coil windings 51 in the central stressing region 60 for this type of coil 50 encounters forces like a bending beam with a pulling force in the center of the stressing region 60 counteracted with a push near the outside of the stressing region 60.

The goal is to perform work on the work piece 90 and not on the coil 50. With the perfectly cylindrical coil 70, the curved bending beam stretches and weakens itself, especially with tangential forces acting outwards on the edges of the coil windings 71. With the coil winding geometry 51, any inside tangential forces in the center of the stressing region 60 does not create the stress to stretch and deform the conductor material.

Cylindrical coil 50 also incorporates a clamp 58 to constrain and even place the coil windings 51 of the stressing region 60 into a preloaded compression. The outside clamp 58 around the stressing region 60 constrains the coil windings 51 between center core 52 with screw 59. By tensioning screw 59 on coil base 55, the stressing region 60 is placed in compression. The center core 52 may be one piece incorporating the dielectric terminal 54 and the coil base 55. The center core 52, terminal 54, coil base 55, outside clamp 58, and outside shell 53 materials may be composite fiberglass, electrical grade phenolic, or similar material with sufficient electrical and mechanical properties.

The screw 59 shown is nonmagnetic stainless steel but could also be other conductive or insulating materials.

To take advantage of clamp 58, the aperture 65 is altered from the prior art aperture 85, shown in FIGS. 2B & 2D. Instead of a tapered height, each coil winding 51 in the stressing region 60 is made the same height. This increases the magnetic field 130 produced in front of the stressing region 60 as a result of higher current concentration. Consequently, the higher magnetic field 130 improves the pulling efficiency of the coil windings 51. More importantly, each winding is completely captured by the clamp 58 to oppose the tangential forces resulting from the strong central magnetic field 130. Note that there are other methods of constraining or clamping the stressing region 60. A clamp 58 requires at least one component in tension. For example, the shell 53 could be used as the tension component if a wedge were driven in between to preload the stressing region 60.

Figure 4A:
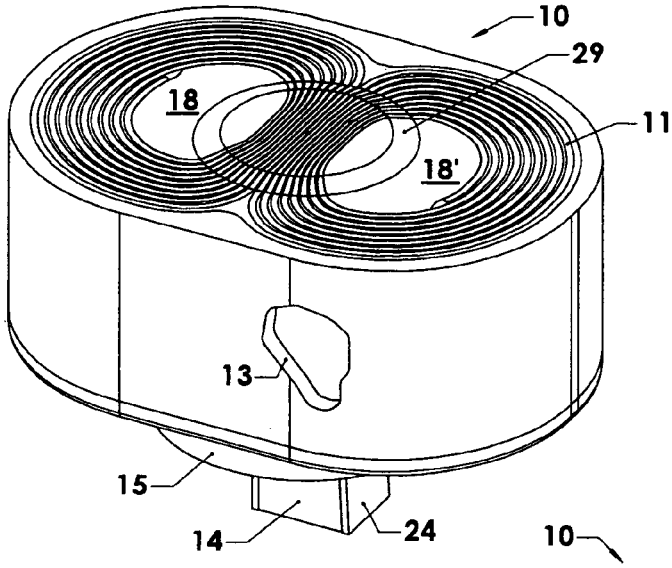
FIG. 4A is a perspective view of a work coil with symmetric windings and clamped linear stressing region.
Figure 4B:
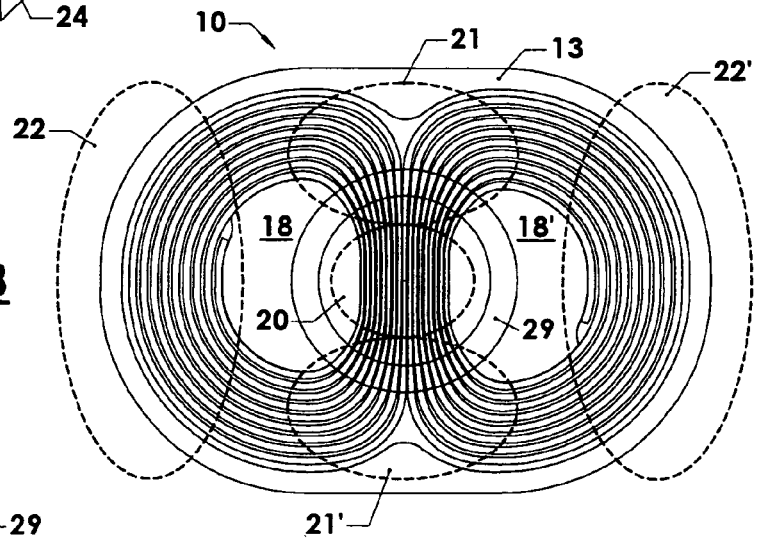
FIG. 4B is a top plan view of the work surface of the coil shown in FIG. 4A.
Figure 4C:
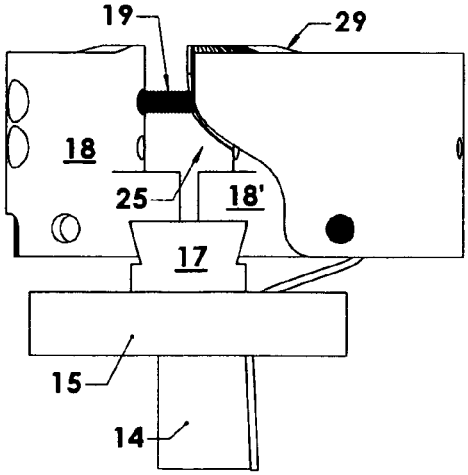
FIG. 4C is a side elevation view of the clamp and half the conductor windings of the coil shown in FIG. 4A.

FIGS. 4A, 4B, and 4C shows the preferred embodiment of the invention, work coil 10. Work coil 10 is composed of similar basic coil components. The dipole conductive coil 10 consists of layers of insulated windings 11, encapsulated within shell 13. The coil base 15 and terminal dielectric 14 with conductive terminals 24 can be made interchangeable with prior art coils 70. Instead of a single center core, there are now two separate but identical clamp cores 18, 18'. Similar to clamp 58 in cylindrical coil 50, the clamp cores 18, 18' can be tensioned with screws 19 to preload the central linear stressing region 20 into compression. This is done by placing an interlocking wedge feature 17 on coil base 15 into compression with clamp cores 18, 18'.

The dipole coil 10 is now symmetric with a linear stressing region 20 in the center. Due to the dipole nature of the coil 10, the return path regions 22, 22' are split into two equivalent but separate areas, which further reduces the magnetic field there. The lead-in regions 21, 21' consists of tapered windings 11 that can vary in thickness between the stressing region 20 and the return path regions 22, 22'. The machined area 25 is similar in function to the aperture 65 and slot 67, which varies the height of the windings 11 between the stressing region 20 and the return path regions 22, 22'. Slot 88 in the return path winding region 82 of the cylindrical coil 70, as shown in FIG. 2B, 2D, is not necessary but could be implemented. Instead, coil 10 is shown with a sloped face 29 which helps decouple the return path regions 22, 22' from the work piece 90 at high frequency. The sloped face 29 also has the advantage of increasing the preload pressure exerted by an operator locally over the stressing region 20 on the work piece 90.

Figure 5:
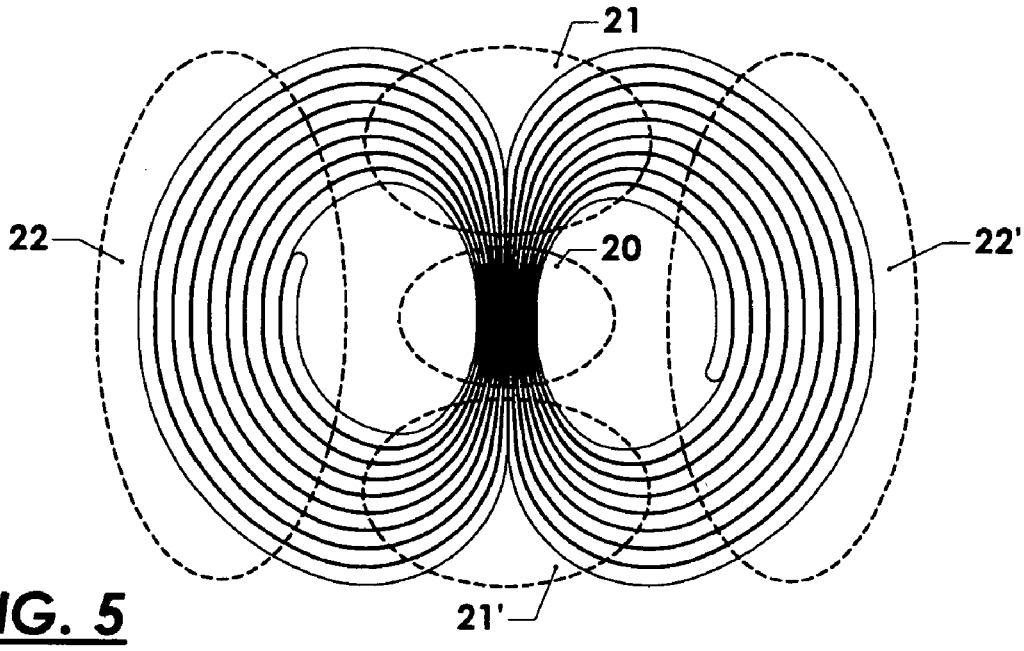
FIG. 5 is an illustration of the work surface of a coil with higher current density and tapered conductor windings.

It is beneficial to further increase the ratio of winding thickness between the stressing region 20 and the return path regions 22, 22', as shown in FIG. 5. The tapered lead-in region 21 helps sink heat away from the stressing region 20. The resistance of the return path regions 22, 22' is kept low with greater conductive area and the corresponding magnetic field of the return path region 22, 22' is further reduced. With a higher winding density in the stressing region 20, the magnetic field is increased. That improves the efficiency of the coil 10 and is limited only by the windings 11 in the stressing region 20 being capable of withstanding the stressing forces. The goal is to do work on the work piece 90 and NOT on the coil 10.

As we further increase the ratio of winding thickness between the stressing region 20 and the return path region 22, 22', or with use of harder conductor materials that are not easily formed into complex geometry, we become increasingly reliant on a method of manufacture using wire EDM. To use this method, first the machined area 25, the sloped face 29, and the pockets for the clamp core 18 are CNC milled from a solid block of conductor material. Side access holes for screws 19 are drilled. The wire EDM is started from each clamp core 18, 18' pocket to cut a single winding at a time in a spiral fashion from the inside out. The outer shape and final winding is cut last to release the coil windings 11 from the block. A non-conductive shelf is made for the wire EDM machine lower arm so that as the windings 11 are cut they rest freely and slide on the table. One parameter and drawback of wire EDM that has to be controlled or accounted for is the heat effected zone of the cut, where the material is burned away and may even be redeposited leaving a thin layer of weak softened material on the walls of the windings 11. This may be compensated for and cleaned up by etching the windings 11 in acid.

Figure 6A:
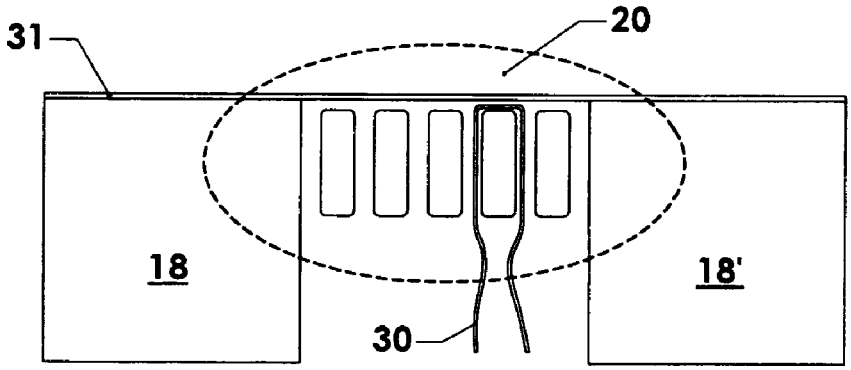
FIG. 6A is a cross-sectional view of conductor windings in a clamped stressing region.

After the windings 11 are cut via wire EDM they are flexible like a spring. Shown in FIG. 6A, this makes it easier to hand wind dielectric insulation 30 around windings 11. Many fabrics and dielectric materials can be used for dielectric insulation 30. Kevlar provides the best excellent mechanical strength but thin materials like polyimide film may also be used to help thermally insulate the hot windings 11 and provide excellent dielectric 30. The wire EDM cut width through the stressing region 20 can be made wider than the desired final dielectric thickness. The coil 10 is flexible like a spring so the final dimensions of the resulting stressing region 20 is a simple function of leftover conductor material and applied dielectric thickness. While it is important to have even coverage of dielectric 31 on every winding in the stressing region 20, it s less of a requirement in the return path region 22. After the coil 10 is clamped together on coil base 15, as shown in FIG. 4C, and fitted inside shell 13 it may be clamped down on a mold release surface. The coil 10 is then potted or encapsulated using vacuum pressure impregnation and cured. Finally, a final layer of dielectric 31 is applied on the surface of the coil 10. Dielectric 31 may be polyimide or similar material with sufficient dielectric strength to withstand the voltage between any coil winding 11 and the conductive work piece 90.

Figure 6B:
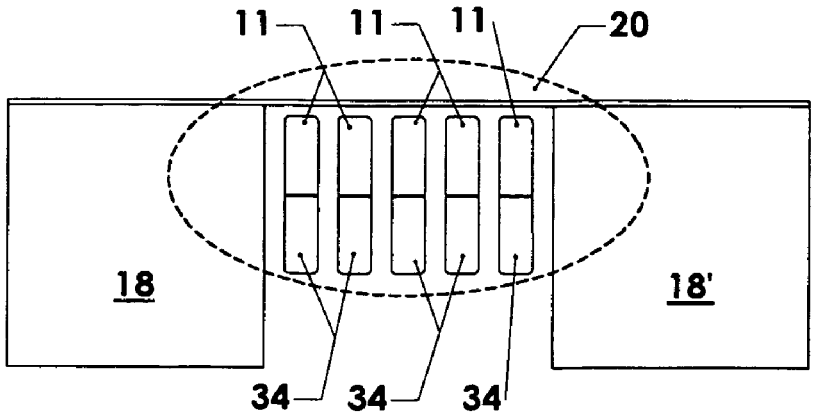
FIG. 6B is a cross-sectional view of conductor windings strengthened with a secondary metal in the clamped stressing region.

The embodiment of the present invention, shown in FIG. 6B, further strengthens the windings in the stressing region 20. A higher conductivity coil winding 11, such as copper, can be explosively bonded to a lower conductivity material 34 such as titanium or stainless steel. This technique allows higher current densities in a smaller copper region while gaining material and geometry strength in the windings 11.

In compliance with die statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An improved electromagnetic work coil for removing dents from a conductive work piece, comprising:

a. a coil with insulated conductor windings passing through a clamped stressing region;

b. at least one clamp member located on said stressing region, said clamp member including two clamp surfaces and a part in tension outside of the stressing region to tangentially compress said conductor windings in the stressing region, and;

c. said conductor windings forming symmetric paths to form symmetrically aligned magnetic poles around said clamped stressing region, said conductor windings being tapered to increase in height and width outside of the stressing region to improve thermal and electrical conductivity and decrease the magnetic field outside of the stressing region.

2. An improved electromagnetic work coil for electromagnetic dent removal with a power supply that slowly energizes and more rapidly de-energizes said work coil to inductively impart a pulling force on an adjacent conductive work piece, said work coil comprising a coil with windings that include a conductor surrounded by insulation, said work coil divided into regions with a working surface to be placed adjacent to said conductive work piece, said windings passing through at least one stressing region and at least one return path region, said windings including a first winding turn and a second winding turn, the portion of said windings passing through said return path region being wider in a direction that increases the distance from said first winding turn to said second winding turn than the portion of said windings passing through said stressing region.

3. The work coil as recited in claim 2, wherein said windings in said stressing region are constrained by at least one clamp member, the clamp member including two clamp surfaces on opposing sides of said stressing region, said clamp member applying a pressure to tangentially compress the windings in the said stressing region.

4. The work coil as recited in claim 2, wherein said windings are divided into two return path regions so the combined widths of the portions of said windings in said return path regions are greater than the width of the portion of said conductor windings that pass through said stressing region.

5. The work coil as recited in claim 4, wherein said windings are equally divided into said return path regions to form a symmetrically balanced magnetic field around said windings passing through said stressing region.

6. The work coil as recited in claim 2, wherein said conductor in the portion of said windings passing through said return path region is thicker in the direction measured on said working surface than said conductor in the portion of said windings passing through said stressing region.

7. The work coil as recited in claim 2, wherein said insulator in the portion of said windings passing through said return path region is thicker than said insulator in the portion of said windings passing through said stressing region.

8. The work coil as recited in claim 2, wherein said conductor in the portion of said windings passing through said stressing region are strengthened behind with a bonded secondary conductor having greater electrical resistance.

9. An improved electromagnetic work coil for electromagnetic dent removal with a power supply that slowly energizes and more rapidly de-energizes said work coil to inductively impart a pulling force on an adjacent conductive work piece, said work coil comprising a coil with windings that include a conductor surrounded by insulation, said windings including a first winding turn and a second winding turn, said windings passing through at least one stressing region and at least one return path region, the distance from said first winding turn to said second winding being greater in said return path region than the distance from said first winding turn to said second winding turn in said stressing region.

* * * * *

UNITED STATES PATENT AND TRADEMARK OFFICE

CERTIFICATE OF CORRECTION

PATENT NO. : 7,068,134 B2
APPLICATION NO. : 10/627257
DATED : June 27, 2006
INVENTOR(S) : Robert F. Olsen It is certified that error appears in the above-identified patent and that said Letters Patent is hereby corrected as shown below:

The Inventor name is incorrectly printed on the front page of the Certifcate of Patent as "Robert R. Olsen". The correct spelling for the Inventor is "Robert F. Olsen.

Signed and Sealed this

Fifth Day of September, 2006

JON W. DUDAS
*Director of the United States Patent and Trademark Office*